US005982344A

United States Patent [19]

Tokunaga

[11] Patent Number: 5,982,344

[45] Date of Patent: Nov. 9, 1999

[54] METHOD FOR DRIVING A PLASMA DISPLAY PANEL

[75] Inventor: Tsutomu Tokunaga, Yamanashi-ken, Japan

[73] Assignee: Pioneer Electronic Corporation, Tokyo, Japan

[21] Appl. No.: 09/052,973

[22] Filed: Apr. 1, 1998

[30] Foreign Application Priority Data

Apr. 16, 1997 [JP] Japan ..... 9-114467

[51] Int. Cl.[6] ..... G09G 3/28

[52] U.S. Cl. ..... 345/67; 345/208

[58] Field of Search ..... 345/67, 208

[56] References Cited

U.S. PATENT DOCUMENTS 5,187,578 2/1993 Kohgami et al. ..... 348/910

5,420,602 5/1995 Kanazawa ..... 345/67

5,483,252 1/1996 Shigeta ..... 345/67

5,790,087 4/1998 Shigeta et al. ..... 345/67

*Primary Examiner*—Regina Liang

*Assistant Examiner*—Anthony J. Blackman

*Attorney, Agent, or Firm*—Nikaido Marmelstein Murray & Oram LLP

[57] ABSTRACT

A plasma display panel has a plurality of first and second row electrodes, a plurality of data electrodes which intersect with the row electrodes to form a pixel at every intersection, an address period in which display data pulses are applied to the data electrodes. A scanning pulse is applied to each of the second row electrodes, thereby selecting lighted pixels and unlighted pixels. The width of the scanning pulse applied in the address period is changed dependent on the second row electrode.

3 Claims, 4 Drawing Sheets

METHOD FOR DRIVING A PLASMA DISPLAY PANEL

BACKGROUND OF THE INVENTION

The present invention relates to a method for driving a plasma display panel (PDP) of a surface discharge type.

Recently, as a display device becomes large in size, thickness of the display device is desired to be thin. Therefore, various types of display devices of thin thickness are provided. As one of the display devices, an ACPDP is known.

A conventional ACPDP comprises a plurality of data electrodes (address electrodes) and a plurality of row electrodes (sustain electrodes) formed in pairs and disposed to intersect the data electrodes. A pair of row electrodes form one row (one scanning line) of am image. The data electrodes and the row electrodes are covered by dielectric layers respectively, at a discharge space. At the intersection of each of the data electrodes and each pair of row electrodes, a discharge cell (pixel) is formed. Each of the row electrodes comprises a transparent electrode and a bus electrode layered on the transparent electrode.

FIG. 4 shows a timing chart of drive signals for driving the conventional ACPDP.

A reset pulse RPx of positive voltage having a long rising time (long time constant) is applied to each of the row electrodes as sustain electrodes X1–X*n*. At the same time, a reset pulse RPy of negative voltage having a long rising time is applied to each of the row electrodes Y1–Y*n*. Thus, all of the row electrodes in pairs in the PDP are excited to discharge, thereby producing charged particles in the discharge space at the pixel. Thereafter, when the discharge is finished, wall charge is formed and accumulated on the discharge cell (A reset all at once period).

Here, in order to regulate the discharge and emission of light caused by the reset pulse which has no connection with the display and to improve the contrast, the reset pulses RPx and RPy having long rising time (long time constant) are used.

Then, pixel data pulses DP1–DP*n* corresponding to the pixel data for every row are applied to the pixel data electrodes as address electrodes D1–D*m* in order in accordance with display data. At that time, scanning pulses (selecting and erasing pulses) SP are applied to the row electrodes Y1–Y*n* in order in synchronism with the timings of the data pulse DP1–DP*n*.

Furthermore, priming pulses PP of positive voltage are applied to the row electrodes Y1–Y*n*, immediately before the scanning pulses SP are applied.

In the discharge space, the charged particles obtained by the operation of reset all at once are reduced as the time passes. Therefore, the priming pulse PP is applied to the row electrodes for reproducing the charged priming particles in the discharge space. Thus, address operation is stabilized.

At the time, only in the pixel to which the scanning pulse SP and the pixel data pulse DP are simultaneously applied, the discharge occurs, so that the wall charge produced at the reset all at once period is erased.

On the other hand, in the pixel to which only the scanning pulse SP is applied, the discharge does not occur. Thus, the wall charge produced at the reset all at once period is held. Namely, a predetermined amount of the wall charge is selectively erased in accordance with the pixel data (An address period).

Next, a discharge sustaining pulse IPx of positive voltage is applied to the row electrodes X1–X*n*, and a discharge sustaining pulse IPy of positive voltage is applied to the row electrodes Y1–Y*n* at offset timing from the discharge row pulses IPx.

During the discharge sustaining pulses are continuously applied, the pixel which holds the wall charge sustains the discharge and emission of light (A discharge sustaining period).

In the discharge sustaining period, a first pulse of the discharge sustaining pulse IPx is set to have a pulse width wider than the subsequent pulses and the discharge sustaining pulse IPy.

The reason why the first pulse is wide will be described hereinafter.

As aforementioned, when the discharge occurs, the charged priming particles are produced, and the produced charged priming particles reduce as the time passes. As the number of charged particles reduce, the time from the application of the pulse to the start of the discharge (discharge production delay time) becomes long, and the discharge starting time at discharge cells (discharge statistics delay time) becomes uneven. In such a state, when the first pulse of the discharge sustaining pulse is applied, the discharge may not occur. Therefore, even if the subsequent pulses are applied, it is strongly possible not to occur the discharges.

Consequently, in the embodiment, the width of the first pulse is set wider than the subsequent pulses. Namely, the width of the first pulse is set larger than the sum of the discharge production delay time, the discharge statistics delay time, and the time necessary to discharge. Therefore, it is possible to ensurely produce the discharge by the first pulse of the discharge sustaining pulse IPx.

Then, wall charge erasing pulses EP are applied to the row electrodes Y1–Y*n* for erasing the wall charges formed on the row electrodes. Thus, the wall charges formed on the row electrodes X1–X*n* and Y1–Y*n* are erased, whereby the wall charges in the lighted and unlighted pixels are approximately uniformed (A wall charge erasing period).

In the driving method of the PDP, the reset pulse having a gentle waveform at the rise is applied to the row electrodes all at once, thereby resetting all at once. In the discharge sustaining period, the pulse width of the first pulse of the discharge sustaining pulse which is applied to the row electrodes X1–X*n* is set to a large width.

In the conventional method, the reset pulse having the long time constant is employed for weakening the reset discharge, thereby improving the contrast. However, since the reset discharge is weak because of the reset pulse of the long time constant, the amount of priming particle (charged particle) formed in the discharge space is small. Therefore, the priming pulses PP are applied immediately before the scanning pulses SP for reproducing the priming particles which are produced when the reset discharge occurs and reduce as the time passes in the discharge space so as to stabilize the address operation.

On the other hand, in order to display the PDP of high definition, it is necessary to write the display data at a high speed in the address period. However, in the address period, on about the lines including at least a line to be scanned first, the timing of priming discharge by the priming pulses PP becomes uneven. Therefore, selecting and erasing discharge produced by the selecting and erasing pulse (scanning pulse) applied immediately after the priming pulse becomes unstable.

The reason will be described. On a subsequent line which is scanned after the scanning of lines including the first scanning line, since the priming discharge (and selecting and erasing discharge) has occurred on the line at the upper side of the subsequent line, a large amount of priming particles are applied to the subsequent line to be scanned at the time. Thus, the discharge easily occurs on the subsequent line. To the contrary, on the lines including the first scanning line, since the amount of priming particles is small, the lines are in a difficult condition to occur the discharge.

SUMMARY OF THE INVENTION

An object of the present invention is to provide a method for driving a plasma display panel of a surface discharge type in which the selecting and erasing discharge becomes stable, thereby obtaining the PDP of high definition.

According to the present invention, there is provided a method for driving a plasma display panel having a plurality of first and second row electrodes, a plurality of data electrodes which intersect with the row electrodes to form a pixel at every intersection, an address period in which display data pulses are applied to the data electrodes, and a scanning pulse is applied to each of the second row electrodes, thereby selecting lighted pixels and unlighted pixels, and a discharge sustaining period in which discharge sustaining pulses are applied to the first and second row electrodes so as to sustain the lighted and unlighted pixels.

The method comprises changing a width of the scanning pulse applied in the address period dependent on the second row electrode.

The scanning pulse may comprise a selecting and writing pulse, the display data pulses and selecting and writing pulses are applied to the second row electrodes in the address period so that the wall charges are selectively formed, thereby selecting lighted pixels and unlighted pixels, the width of the selecting and writing pulse applied to lines including a first scanning line is set to be smaller than a pulse width of a pulse applied to a subsequent line.

In an aspect of the present invention, the scanning pulse comprises a priming pulse and a selecting and erasing pulse applied to the second row electrode immediately after the application of the priming pulse, a reset all at once period is provided before the address period for forming wall charges in all pixels, the display data pulses and the selecting and erasing pulses are applied to the second row electrodes, thereby selectively erasing the wall charges and selecting lighted pixels and unlighted pixels in the address period, the width of the priming pulse applied to lines including first scanning line is set to be larger than a width of a pulse applied to a subsequent line.

These and other objects and features of the present invention will become more apparent from the following detailed description with reference to the accompanying drawings.

DETAILED DESCRIPTION OF THE PREFERRED EMBODIMENTS

Figure 1:
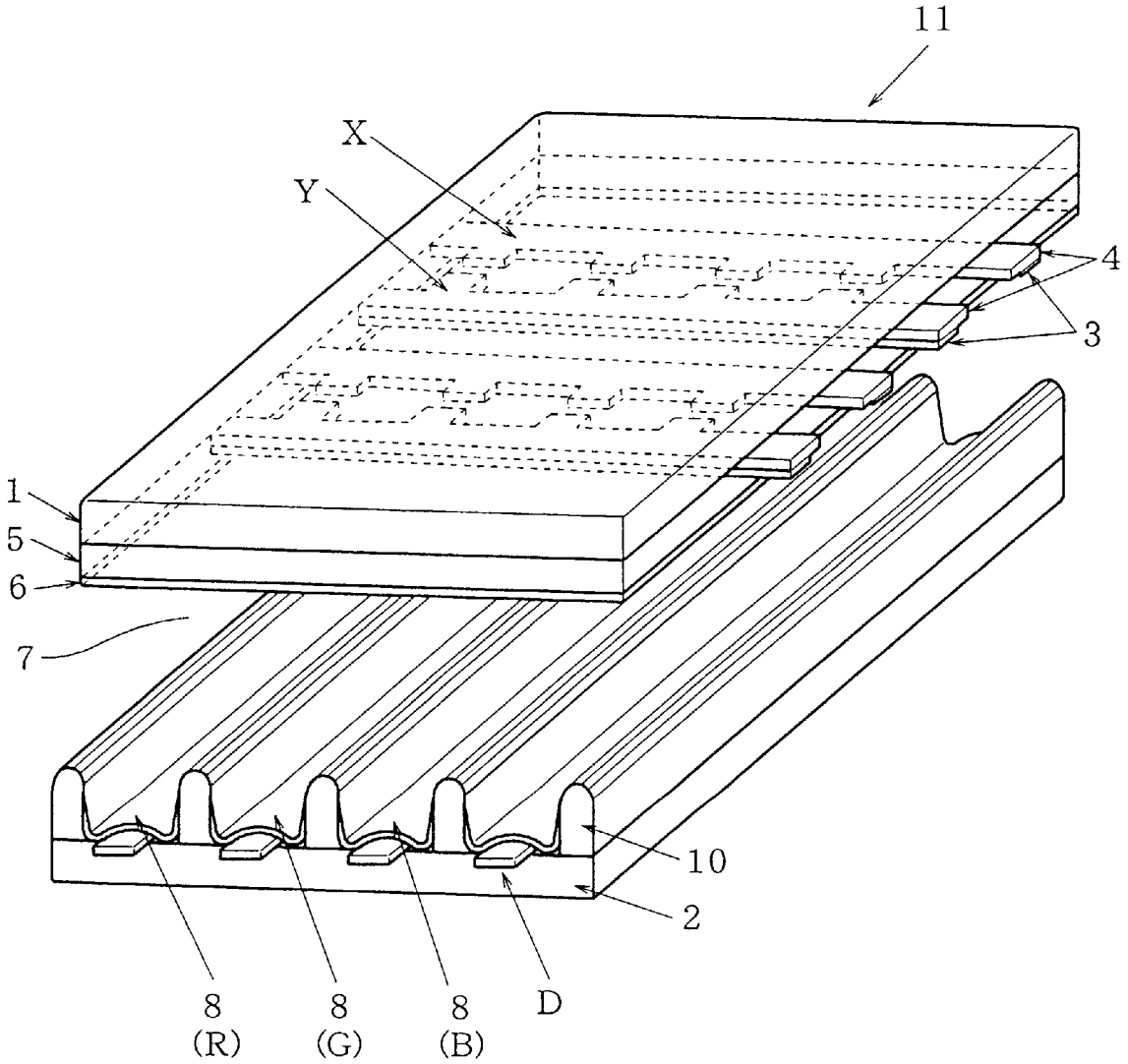
FIG. 1 is a schematic perspective view showing a plasma display panel of a surface discharge type according to the present invention.

FIG. 1 shows a PDP of a surface discharge type according to the present invention. A PDP 11 comprises a pair of glass substrates 1 and 2 disposed opposite to each other, interposing a discharge space 7 therebetween. The glass substrate 1 as a display portion has row electrodes (sustain electrodes) X and Y which are alternately disposed in pairs to be parallel with each other at the inside portion thereof. The row electrodes X and Y are covered by a dielectric layer 5 for producing wall charge. A protection layer 6 made of MgO is coated on the dielectric layer 5.

Each of the row electrodes X and Y comprises a transparent electrode 4 formed by a transparent conductive film having a large width and a bus electrode (metallic electrode) 3 formed by a metallic film having a small width and layered on the transparent electrode 4.

On the glass substrate 2 as a rear member, a plurality of elongated barriers 10 are provided at the inside portion thereof for defining the discharge space 7. The barrier 10 extends in the direction perpendicular to the row electrodes X, Y. Between the barriers 10, data electrodes (address electrodes) D are formed to intersect the row electrodes X and Y of the glass substrate 1. A phosphor layer 8 having a predetermined luminous color R, G or B covers each of the data electrodes D and opposite side portions of the barrier 10. The discharge space 7 is filled with rare gases. Thus, a pixel (including a discharge cell) is formed at the intersection of the row electrodes X and Y on the glass substrate 1 and the data electrode D on the glass substrate 2. Since the PDP having a plurality of pixels is formed, it is possible to display images.

Figure 2:
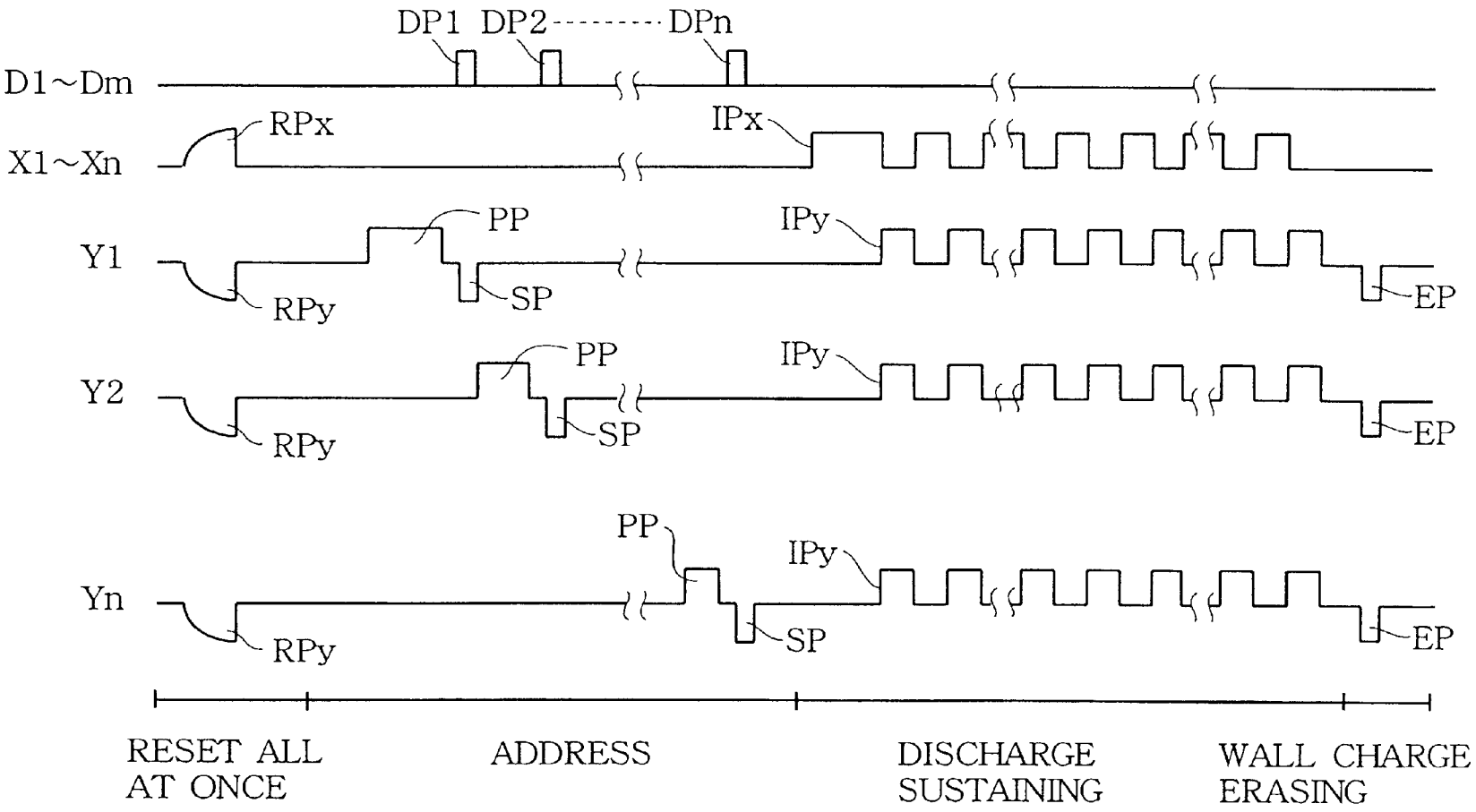
FIG. 2 is time charts showing drive signals for driving the plasma display panel.

Operation of the PDP 11 will be described. FIG. 2 shows a timing chart of drive signals for driving the PDP by a selecting and erasing address method.

A reset pulse RPx of positive voltage having a long rising time (long time constant) is applied to each of the row electrodes as sustain electrodes X1–X*n*. At the same time, a reset pulse RPy of negative voltage having a long rising time is applied to each of the row electrodes Y1–Y*n*. Thus, all of the row electrodes in pairs in the PDP are excited to discharge, thereby producing charged particles in the discharge space at the pixel. Thereafter, when the discharge is finished, wall charge is formed and accumulated on the discharge cell (A reset all at once period).

Here, in order to regulate the discharge and emission of light caused by the reset pulse which has no connection with the display and to improve the contrast, the reset pulses RPx and RPy having long rising time (long time constant) are used.

Then, pixel data pulses DP1–DP*n* corresponding to the pixel data for every row are applied to the pixel data electrodes as address electrodes D1–D*m* in order in accordance with display data. At that time, scanning pulses (selecting and erasing pulses) SP are applied to the row electrodes Y1–Y*n* in order in synchronism with the timings of the data pulse DP1–DP*n*.

Furthermore, priming pulses PP of positive voltage are applied to the row electrodes Y1–Y*n*, immediately before the scanning pulses SP are applied.

In the discharge space, the charged particles obtained by the operation of reset all at once are reduced as the time passes. Therefore, the priming pulse PP is applied to the row electrodes for reproducing the charged priming particles in the discharge space. Thus, address operation is stabilized.

At the time, only in the pixel to which the scanning pulse SP and the pixel data pulse DP are simultaneously applied, the discharge occurs, so that the wall charge produced at the reset all at once period is erased.

On the other hand, in the pixel to which only the scanning pulse SP is applied, the discharge does not occur. Thus, the wall charge produced at the reset all at once period is held. Namely, a predetermined amount of the wall charge is selectively erased in accordance with the pixel data (An address period).

Next, a discharge sustaining pulse IPx of positive voltage is applied to the row electrodes X1–X*n*, and a discharge sustaining pulse IPy of positive voltage is applied to the row electrodes Y1–Y*n* at offset timing from the discharge row pulses IPx.

During the discharge sustaining pulses are continuously applied, the pixel which holds the wall charge sustains the discharge and emission of light (A discharge sustaining period).

In the discharge sustaining period, a first pulse of the discharge sustaining pulse IPx is set to have a pulse width wider than the subsequent pulses and the discharge sustaining pulse IPy.

The reason why the first pulse is wide will be described hereinafter as mentioned in the conventional method.

As aforementioned, when the discharge occurs, the charged priming particles are produced, and the produced charged priming particles reduce as the time passes. As the number of charged particles reduce, the time from the application of the pulse to the start of the discharge (discharge production delay time) becomes long, and the discharge starting time at discharge cells (discharge statistics delay time) becomes uneven. In such a state, when the first pulse of the discharge sustaining pulse is applied, the discharge may not occur. Therefore, even if the subsequent pulses are applied, it is strongly possible not to occur the discharges.

Consequently, in the embodiment, the width of the first pulse is set wider than the subsequent pulses. Namely, the width of the first pulse is set larger than the sum of the discharge production delay time, the discharge statistics delay time, and the time necessary to discharge. Therefore, it is possible to ensurely produce the discharge by the first pulse of the discharge sustaining pulse IPx.

Then, wall charge erasing pulses EP are applied to the row electrodes Y1–Y*n* for erasing the wall charges formed on the row electrodes. Thus, the wall charges formed on the row electrodes X1–X*n* and Y1–Y*n* are erased, whereby the wall charges in the lighted and unlighted pixels are approximately uniformed (A wall charge erasing period).

In the driving method of the PDP, the reset pulse having a gentle waveform at the rise is applied to the row electrodes all at once, thereby resetting all at once. In the discharge sustaining period, the pulse width of the first pulse of the discharge sustaining pulse which is applied to the row electrodes X1–X*n* is set to a large width.

Here, the row electrode Y1 is the line to be scanned first. The priming pulse PP applied to the first row electrode Y1 is set to have a pulse width wider than a pulse width of the priming pulse PP applied to the subsequent row electrode Y2.

As shown in FIG. 2, the priming pulse PP applied to the further subsequent row electrode Y*n* is set to have a pulse width smaller than a pulse width of the priming pulse PP applied to the prior row electrode Y2.

From the foregoing, in the embodiment, the pulse width of the priming pulse applied to the lines including the first line scanning is wider than that applied to the subsequent line. Thus, the timing of discharge on the first scanning line is prevented from being uneven, thereby avoiding unstableness of selecting and erasing discharge thereafter. On the subsequent line where the selecting and erasing discharge is stable, the priming pulse is set to have a small pulse width. Thus, the scanning time is shortened. Consequently, it is possible to obtain the PDP of high definition at high speed.

In the embodiment, the pulse width of the priming pulse is varied. Alternatively, the pulse width of the selecting and erasing pulse (scanning pulse) may be varied.

Furthermore, the pulse width of the priming pulse is varied in order every line. Alternatively, the pulse width of the selecting and erasing pulse (scanning pulse) may be varied in order every line. The pulse width of the priming pulse applied to the first scanning line differs from that applied to the subsequent line, thereby obtaining the same effect as described above.

Figure 3:
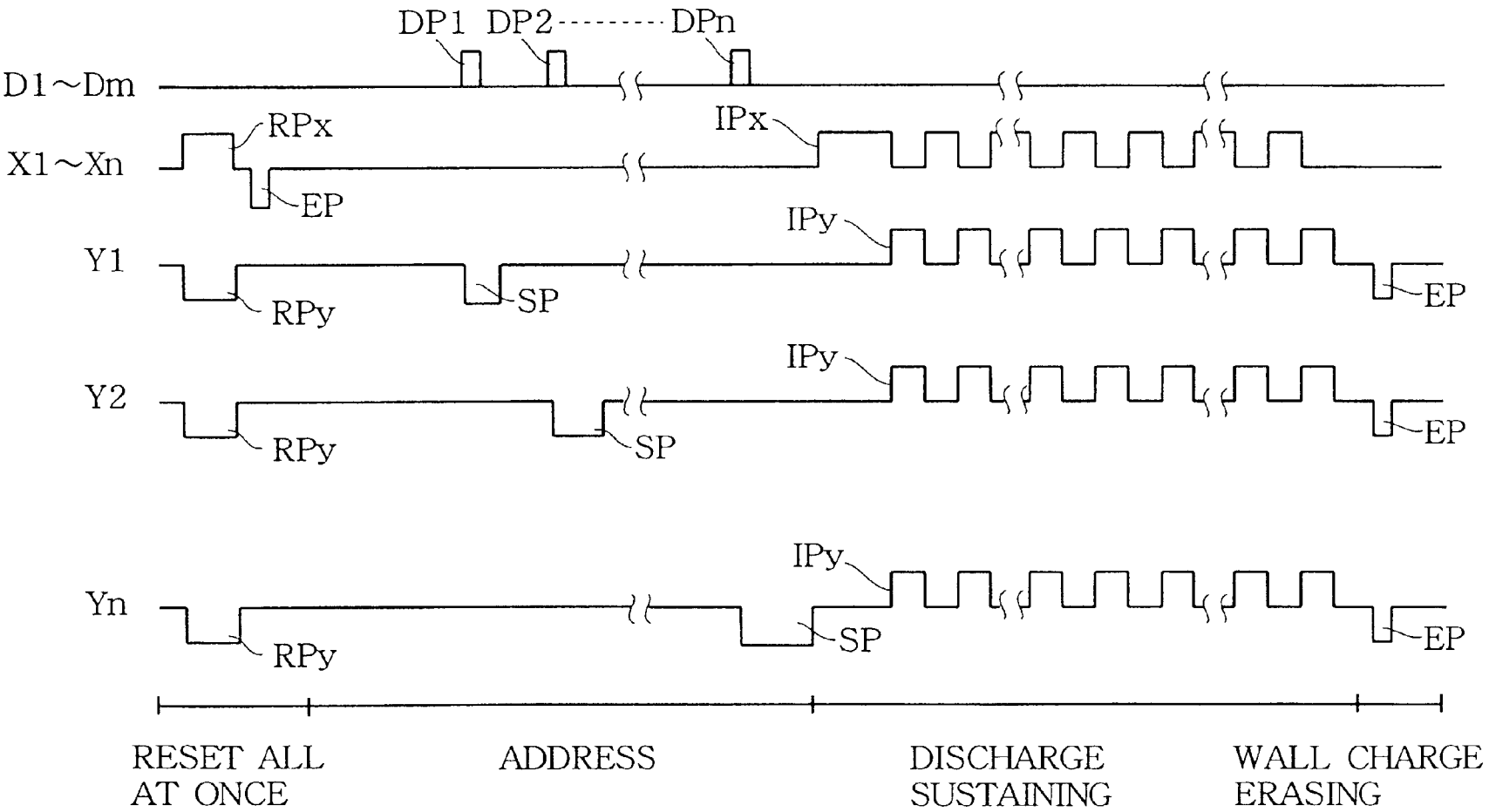
FIG. 3 is time charts showing drive signals for a second embodiment of the present invention.
Figure 4:
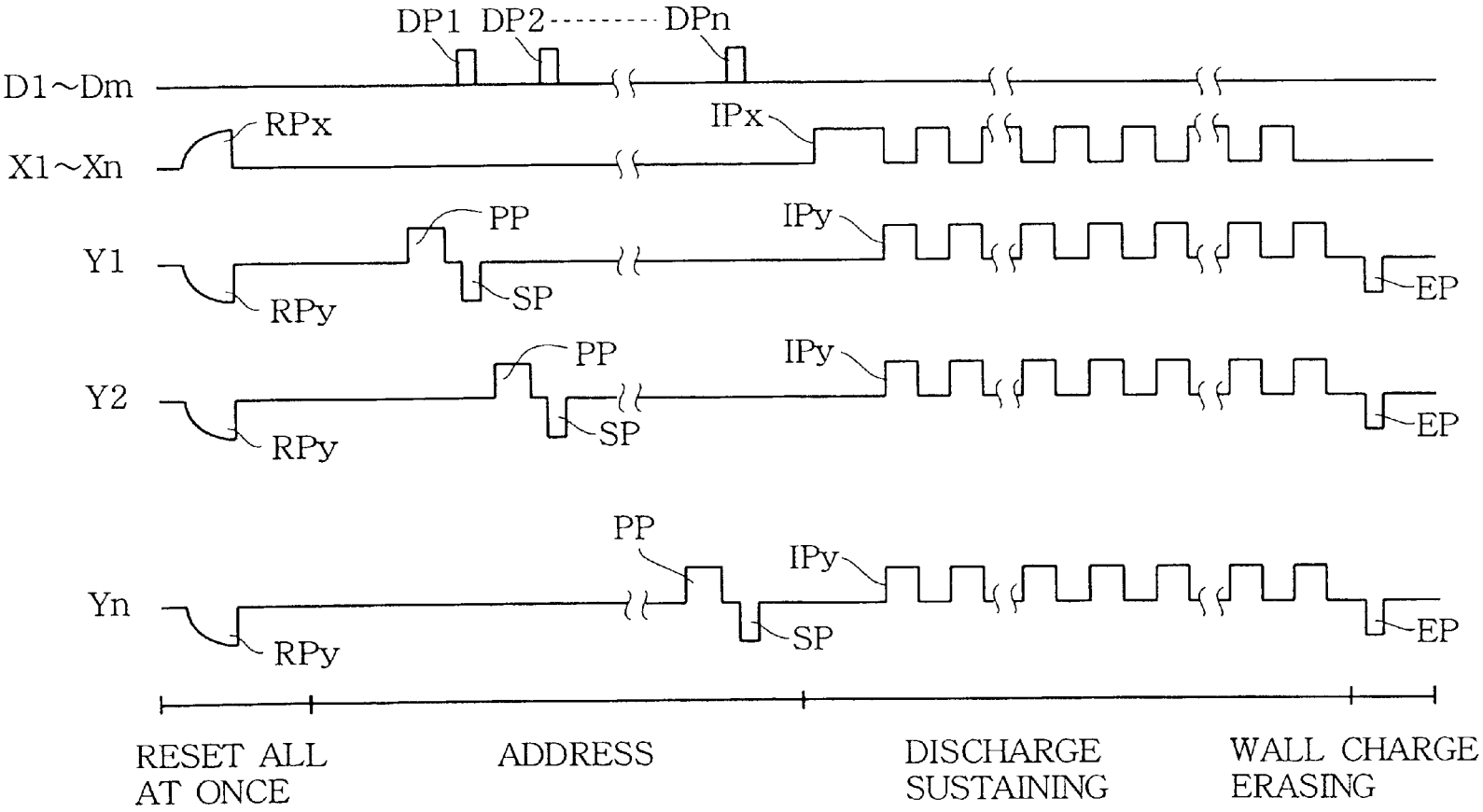
FIG.4 PRIOR ART
FIG. 4 is time charts showing drive signals for a conventional plasma display panel.

FIG. 3 shows time charts of drive signals for a second embodiment employed with a selecting and writing address method.

In the reset all at once period, the reset pulses RPx and RPy are applied to the row electrodes X and Y for producing wall charges on all of the pixels. Thereafter, a wall charge erasing pulse EP is applied to the row electrodes X1–X*n* for erasing the wall charges, thereby initializing all pixels. In this state, a large amount of the priming pulses exist so that the discharge easily occurs.

In the address period, the data pulses DP1–DP*n* and the scanning pulses (selecting and writing pulses) SP are applied for selectively accumulating the wall charges, thereby selecting the lighted pixel and the unlighted pixel.

In the embodiment, the selecting and writing pulse (scanning pulse) SP applied to the lines including the first scanning line is set to have a pulse width smaller than a pulse width of the scanning pulse of the subsequent line. Namely, the pulse width of the scanning pulse SP applied to the lines including first scanning line differs from that applied to the subsequent line. Concretely, the time for scanning the lines including the first scanning line is shortened compared with that for the subsequent lines.

From the foregoing, in the selecting and writing address method, the pulse width of the scanning pulse SP applied to the line including at least the first scanning line is set to have the small width. Thus, the scanning time for the entire operation is reduced.

In the embodiment by the selecting and writing address method, the same operation and effect as the first embodiment by the selecting and erasing address method can be obtained.

In accordance with the present invention, the pulse width of the priming pulse applied to the lines including at least the first scanning line is wider than that applied to the subsequent lines. Thus, the scanning time is shortened. Consequently, it is possible to obtain a PDP of high definition at high speed.

While the invention has been described in conjunction with preferred specific embodiment thereof, it will be understood that this description is intended to illustrate and not limit the scope of the invention, which is defined by the following claims.

What is claimed is:

1. A method for driving a plasma display panel having a plurality of first and second row electrodes, a plurality of data electrodes which intersect with the row electrodes to form a pixel at every intersection, an address period in which display data pulses are applied to the data electrodes, and a scanning pulse is applied to each of the second row electrodes, therein selecting lighted pixels and unlighted pixels, and a discharge sustaining period in which discharge sustaining pulses are applied to the first and second row electrodes so as to sustain the lighted and unlighted pixels, comprising the step of:

applying a width of the scanning pulse to at least one of the lines of the second row electrode different from a width of the second row electrode.

2. The method according to claim 1, wherein the scanning pulse comprises a selecting and writing pulse, the display data pulses are applied to the data electrodes and selecting and writing pulses are applied to the second row electrodes in the address period so that the wall charges are selectively formed, therein selecting lighted pixels and unlighted pixels, the width of the selecting and writing pulse applied to lines including a first scanning line is set to be smaller than a pulse width of a pulse applied to a subsequent line.

3. The method according to claim 1, wherein the scanning pulse comprises a priming pulse and a selecting and erasing pulse applied to the second row electrode immediately after application of the priming pulse, a reset all at once period is provided before the address period for forming wall charges in all pixels, the display data pulses are applied to the data electrodes and the selecting and erasing pulses are applied to the second row electrodes, therein selectively erasing the wall charges and selecting lighted pixels and unlighted pixels in the address period, the width of the priming pulse applied to lines including first scanning line is set to be larger than a width of a pulse applied to a subsequent line.

* * * * *